US007229228B2

(12) United States Patent
Dieudonat et al.

(10) Patent No.: US 7,229,228 B2
(45) Date of Patent: Jun. 12, 2007

(54) APPLICATOR DISPENSER OF A PASTE COSMETIC PRODUCT, TYPICALLY A MASCARA

(75) Inventors: Fabrice Dieudonat, Fosses (FR); Patrick LHoyer, Mouy (FR)

(73) Assignee: Techpack International, Chevilly-Larue (FR)

( * ) Notice: Subject to any disclaimer, the term of this patent is extended or adjusted under 35 U.S.C. 154(b) by 0 days.

(21) Appl. No.: 11/328,130

(22) Filed: Jan. 10, 2006

(65) Prior Publication Data

US 2006/0171763 A1 Aug. 3, 2006

(30) Foreign Application Priority Data

Jan. 20, 2005 (FR) ..... 02 00580

(51) Int. Cl.
*A46B 11/00* (2006.01)
*A46B 17/08* (2006.01)

(52) U.S. Cl. ..... 401/122; 401/121; 401/126; 401/127; 401/129

(58) Field of Classification Search ..... 401/121–124, 401/126–130, 261, 266; 132/218, 317, 320
See application file for complete search history.

(56) References Cited

U.S. PATENT DOCUMENTS

| | | | | |
|---|---|---|---|---|
| 4,403,624 | A | 9/1983 | Montgomery | |
| 4,810,122 | A * | 3/1989 | Cole | 401/122 |
| 5,743,279 | A * | 4/1998 | Gueret | 401/122 |
| 6,026,824 | A | 2/2000 | Gueret et al. | |
| 2001/0038769 | A1 | 11/2001 | Jean-Louis | |

FOREIGN PATENT DOCUMENTS

| | | |
|---|---|---|
| EP | 1 336 353 | 8/2003 |
| FR | 1 563 693 | 4/1969 |

* cited by examiner

*Primary Examiner*—Tuan Nguyen
(74) *Attorney, Agent, or Firm*—Young & Thompson

(57) ABSTRACT

An applicator dispenser includes a body forming a reservoir for the cosmetic product provided with a neck threaded on the outside, a sidewall and a bottom, an applicator having a head threaded on the inside forming a gripping element, an axial rod fixed at its upper end to the head and at its lower end to an application element, a wiper having an upper part fixing the wiper to said neck, and a lower narrowed part designed to wipe the application element. The wiper has an intermediate axial connecting part, which together with the upper and lower narrowed part form a single piece.

16 Claims, 6 Drawing Sheets

APPLICATOR DISPENSER OF A PASTE COSMETIC PRODUCT, TYPICALLY A MASCARA

DOMAIN OF THE INVENTION

The invention relates to applicator dispensers for paste cosmetic products, typically a mascara for eye makeup.

STATE OF THE ART

Applicator dispensers of cosmetic products and mascara in particular include a receptacle forming a reservoir for the said cosmetic product or the said mascara with a threaded neck provided with a wiper, and an applicator comprising an axial rod provided with a threaded cap at one end, and with a brush at the other end, the threaded cap cooperating with the neck to close off the reservoir, and the wiper diameter being chosen to allow passage of the rod and to wipe the brush containing product to be applied every time that the applicator is removed from the reservoir.

Typically, the reservoir is a part made of a plastic material usually formed by moulding, the wiper being a separate part typically made of an elastomer and click fitted into the neck.

The applicator is usually formed by the assembly of at least three parts: one part forming an outer cap, a single piece plastic part comprising the said rod containing an insert or a click fit part in the said outer cap at one end, and a brush or application means designed to be fixed to the other end of the said rod.

Examples of applicator dispensers include applicator dispensers described in the following French patents and particularly those shown in the indicated figures—FR 2 850 549 (FIG. 1), FR 2 796 532 (FIG. 1), FR 2 796 530 (FIG. 1), FR 2 779 041 (FIG. 1), FR 2 771 907 (FIG. 1B), FR 2 762 494 (FIG. 9), FR 2 745 481 (FIG. 9), FR 2 648 686 (FIGS. 1 and 2) and FR 2 627 068 (FIG. 1).

PROBLEMS THAT ARISE

The applicant has observed that applicator dispensers for paste cosmetic products, and typically mascara dispenser applicators, have a relatively low restoration ratio, unlike applicator dispensers for fluid cosmetic products such as nail varnish applicators, and also unlike applicator dispensers for solid products such as lipstick tubes.

The applicant has analysed the phenomena that cause such a disadvantage and has found that every time that the applicator or the brush is used, some of the mascara carried by the brush is deposited around the wiper so as to form an increasing and completely inaccessible mass, as if mascara was gradually transferred from the lower part of the reservoir accessible to the brush to the upper part of the reservoir, typically around the wiper and inaccessible to the brush, such that the restoration ratio with mascaras that are usually not very fluid is of the order of 50%, obviously this rate increasing in the case of a very fluid mascara since in this case the fluid mascara will be able to flow by itself to the bottom of the reservoir.

Furthermore, even in this case, since a volatile fraction of the mascara can evaporate every time that the mascara is used, the mascara tends to harden and to become less and less fluid, the part lifted with the brush each time that the applicator is removed tends to drop less and less into the bottom of the reservoir.

Furthermore, the mascara formula thus tends to change fairly quickly such that mascara becomes more and more difficult to use over time.

The applicant has attempted to develop an applicator dispenser without these disadvantages in other words that has a much higher restoration ratio and also keeps the formulation or composition constant for a longer time making it easily applicable.

DESCRIPTION OF THE INVENTION

The applicator dispenser of a typically paste cosmetic product, for example a mascara, has an axial direction and includes:

a) a body forming a longitudinal reservoir for the said cosmetic product, typically provided with a neck threaded on the outside, a sidewall and a bottom, b) an applicator of the said cosmetic product comprising a head forming a means of gripping the said applicator, the said head typically being threaded on the inside so as to cooperate with the said neck by screwing to seal the said body in a leak tight manner, an axial rod fixed at its upper end to the said head and at its lower end to an application means, the said application means typically dipping into the said product when the said head is screwed to the said neck so that a fraction of the said product can be drawn off later, c) and a wiper comprising an upper part fixing the said wiper to the said neck, and a lower narrowed part designed to wipe the said application means each time that the said applicator is lifted or taken out.

It is characterised in that:

1) the said wiper includes an intermediate axial connecting part between the said upper part and the said lower part, 2) the said upper, intermediate and lower narrowed parts of the said wiper form a single piece part, 3) the said wiper and the said body have an average ratio $H_E/H_R$ equal to at least 0.3, where $H_E$ and $H_R$ are the axial length or height of the said wiper and the depth of the said body respectively, so as to increase the restoration ratio of the said product and the usage duration of the said dispenser.

This applicator dispenser solves the problem that arises. The applicant has observed that applicator dispensers according to the invention have major advantages for the two points mentioned above:

the restoration ratio is strongly increased, from an average of 40–50% to n average of 65–67%, users have observed that the time during which the mascara formulation is easy to apply is approximately doubled, all other things being equal.

Clearly, these are major advantages for users.

DESCRIPTION OF FIGURES

All figures relate to applicator dispensers (1) according to the invention, or to parts of applicator dispensers (1) according to the invention.

All figures are axial sections along the axial direction of the applicator dispenser (1) according to the invention.

DETAILED DESCRIPTION OF THE INVENTION

Figure 4:
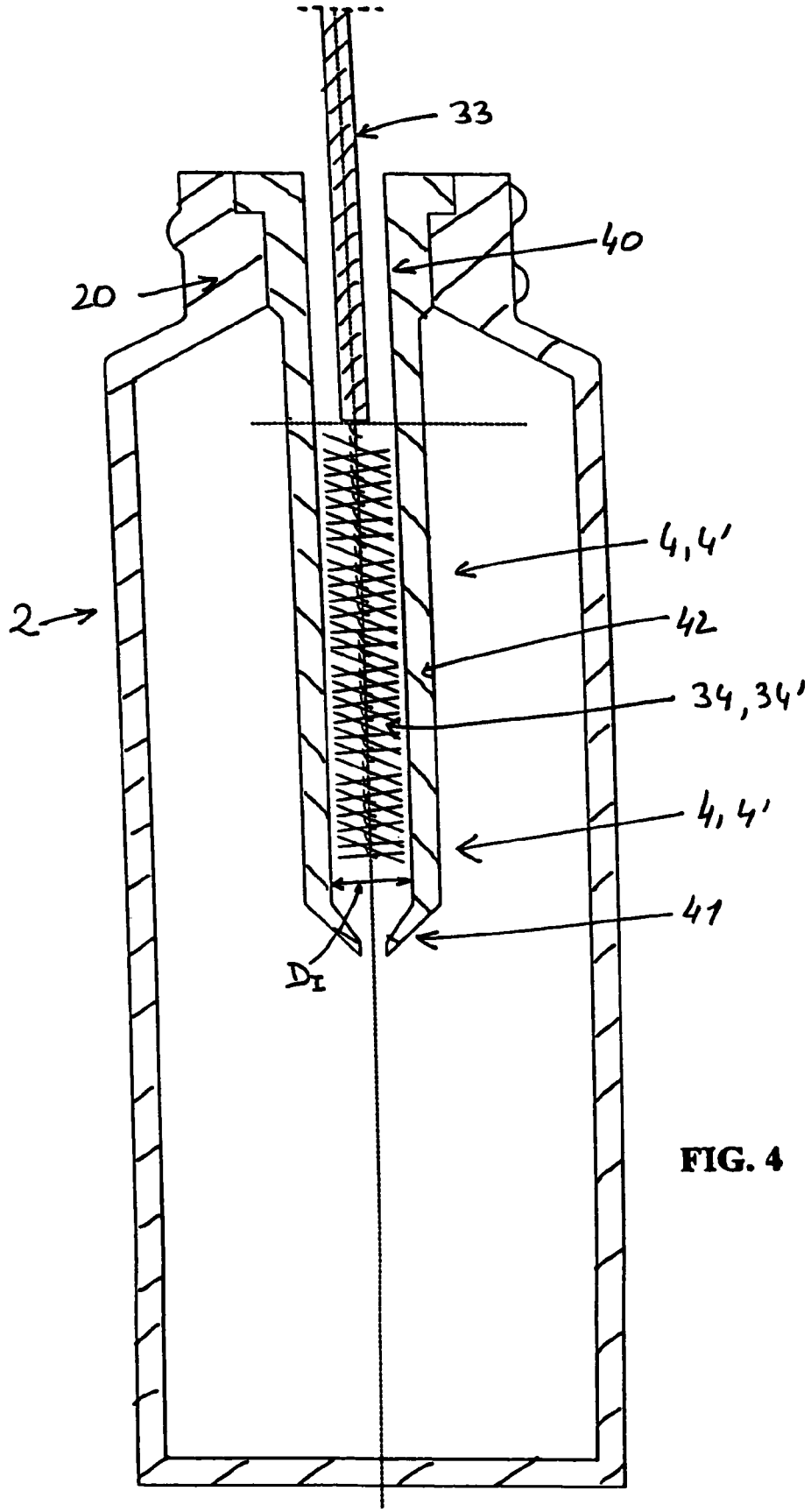
FIG. 4 shows the body (2) of the applicator dispenser (1) in FIG. 1*a* and a partial view of the applicator (3), namely its lower part after the applicator (3) has been unscrewed and partly removed from the body (2), the application means (34) or the brush (34') being shown in the intermediate part (42) of the said insert (4, 4').

According to the invention and as shown on FIG. 4, the said intermediate part (42) of the said wiper (4, 4') may have a typically circular section with an inside diameter $D_I$, equal to at least the circular section of the said application means (34, 34'), such that the said intermediate part (42) does not apply any significant wiping action on the said application means (34, 34') when the said applicator (3) is separated from the said body (2), typically in order to use the said product to makeup the eyelashes.

Figures 1A, 1B:
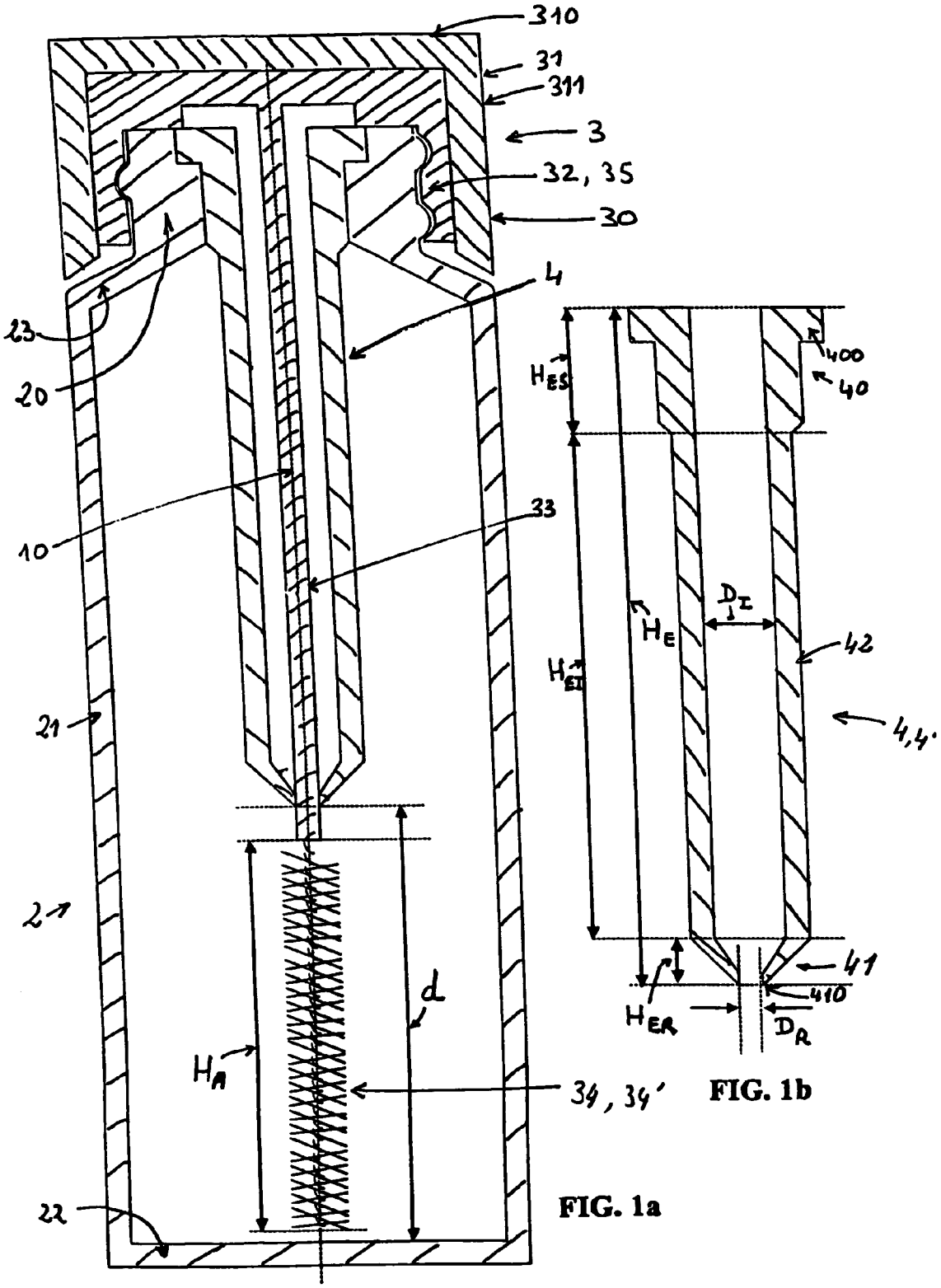
FIG. 1*a* shows the applicator dispenser (1) according to the invention, the head (30) of the applicator (3) being screwed to the neck (20) of the body (2) to close it off.
FIG. 1*b* shows the wiper (4, 4').
Figure 2:
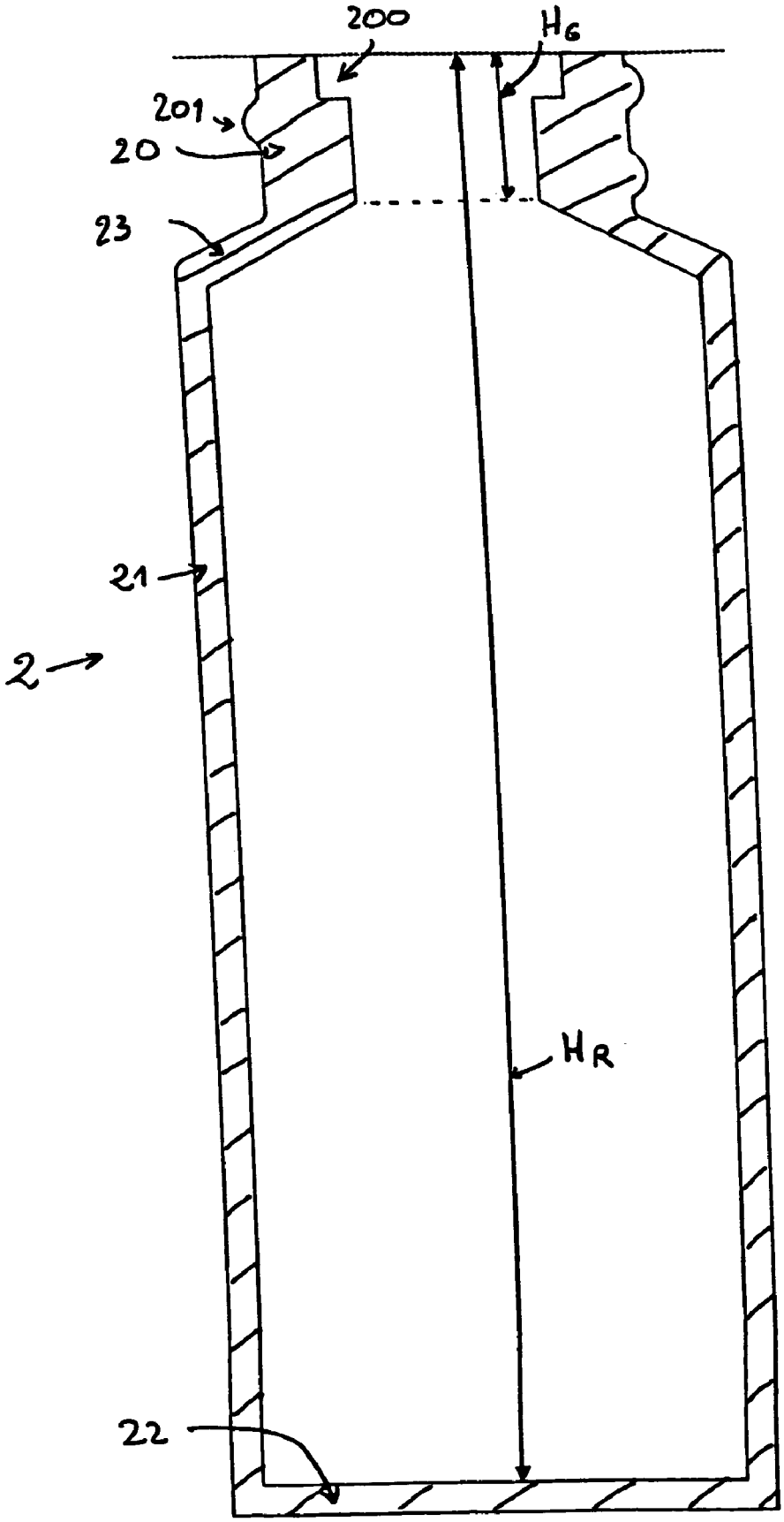
FIG. 2 shows the body (2) of the applicator dispenser (1) in FIG. 1*a*.
Figure 3:
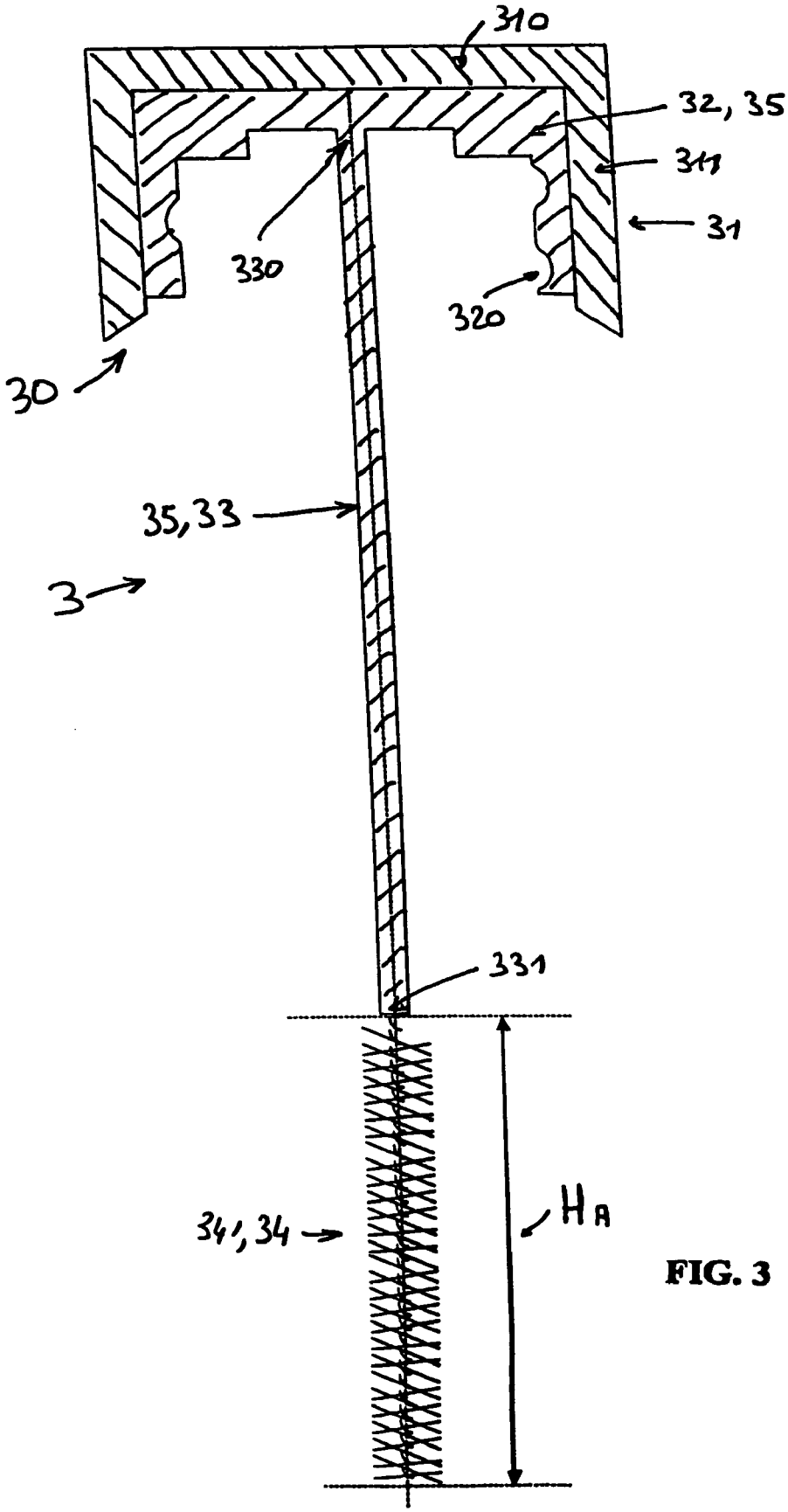
FIG. 3 shows the applicator (3) of the applicator dispenser (1) in FIG. 1*a*.

As shown in FIG. 1*b*, the height $H_{ER}$ of the said lower narrowed part (41) of the said wiper (4, 4') is such that $H_{ER}/H_E$ is less than 0.5 and typically less than 0.2. It will even be possible to have an $H_{ER}/H_E$ ratio of less than 0.1 as shown in FIG. 1*b*, which is advantageous to have a wiping action applied over a short axial distance, particularly to avoid deposition of product in the said wiper.

Furthermore and as shown in FIG. 1*a*, the said lower narrowed part (41) of the said wiper (4, 4') may have a lower end (410) at a distance d from the bottom (22) of the said body (2), the said distance d being between $H_A$ and $1.3\times H_A$, where $H_A$ is the axial length or height of the said application means (34, 34').

The said distance d may be equal to at least $H_A+H_D$, where $H_D$ is the unscrewing height of the said head (30) of the applicator (3) with respect to the said neck (20), the said distance d typically being equal to $H_A+H_D+1$ mm.

This is very advantageous, and in particular contributes to obtaining a high restoration ratio of the said cosmetic product.

Typically, the axial height $H_{ES}$ of the said upper part (40) of the said wiper (4,4') may be substantially equal to the height $H_G$ of the said neck (20) and typically less than 15 mm.

Figure 5:
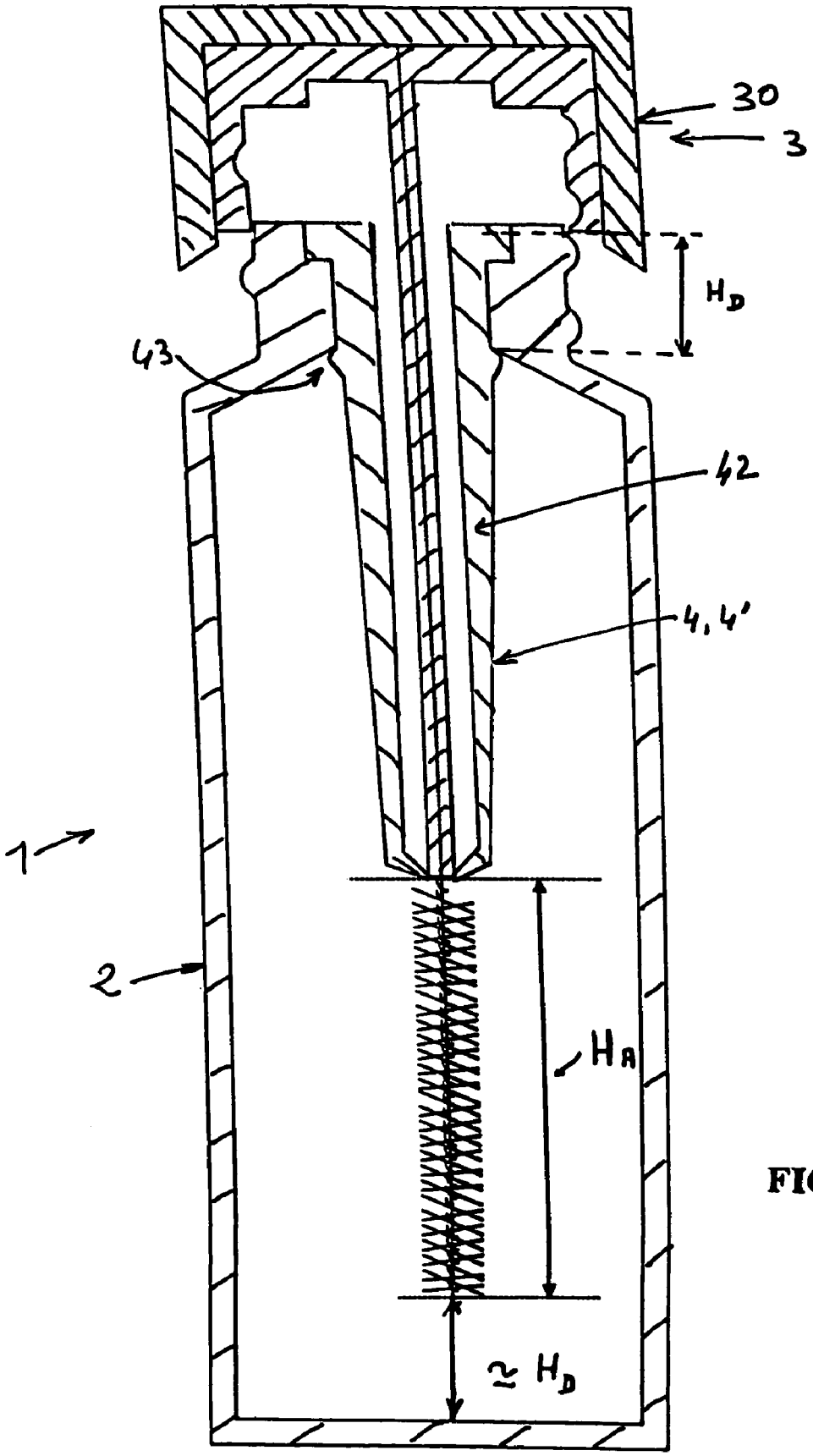
FIG. 5 shows an applicator dispenser in which the head (30) of the applicator (3) is just unscrewed, corresponding to an upwards axial displacement $H_D$ of the applicator (3).
Figure 6:
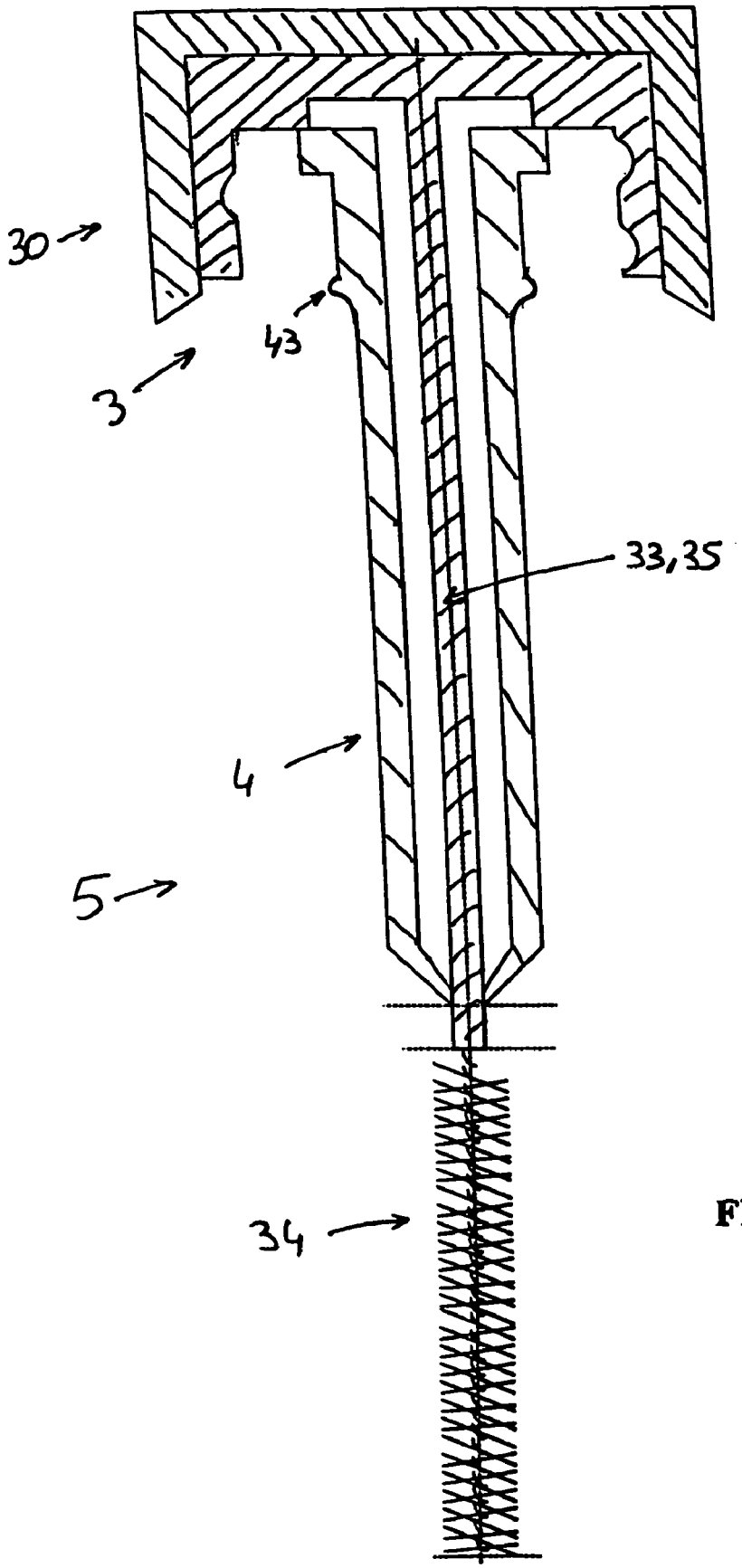
FIG. 6 shows the assembly (5) formed by cooperation of the wiper (4) with the applicator (3).

As shown for example in FIG. 5, the said wiper (4, 4') may be fixed to the said neck (20), typically irreversibly by a click fitting means (43) or by gluing or by welding.

According to the invention, the said intermediate part (42) of the said wiper (4,4') may have a circular section with an inside diameter $D_I$, varying from 3 mm to 5 mm, and the said lower narrowed part (41) of the said wiper (4, 4') may have an orifice diameter $D_R$ varying from 2 mm to 7 mm, such that $D_I/D_R$ is equal to at least 1.5.

Advantageously, and as shown in the figures, the said wiper (4) may form a single piece moulded part (4').

The said wiper (4, 4') may be formed from a plastic material, typically a thermoplastic material, chosen from among PP, PE, PU, SEBS and TPE.

Another purpose of the invention consists of a process for filling an applicator dispenser (1) with a cosmetic product according to the invention. In this process:

a) the said body (2) is procured, b) an assembly (5) is procured or formed containing the said applicator (3) and the said wiper (4, 4'), the said wiper (4, 4') being fixed to the said applicator after having been slid onto the said axial rod (33) and thus placed between the said head (30) and the said application means (34), so that it can be manipulated like a single part, c) the said cosmetic product is procured, d) the said body (2) forming a longitudinal reservoir is filled through its neck (20) with a predetermined quantity of the said cosmetic product, e) and the said neck (20) of the said body (2) is closed by screwing the said assembly (5) to the said body (2) so as to irreversibly fix the said wiper (4, 4') to the said neck (20).

EXAMPLE EMBODIMENTS

The figures show example embodiments of applicator dispensers for mascara according to the invention.

Advantages of the Invention

Apart from the fact that applicator dispensers (1) according to the invention solve the problems that arise, and that they thus avoid the need to have to discard an applicator dispenser still containing a large quantity of cosmetic product and unnecessarily waste the cosmetic product, they have the advantage that they can be used with all sorts of application means (34) or brushes (34'), and also a wide variety of formulations of cosmetic products.

List of Remarks

Applicator dispenser . . . 1
Axial direction . . . 10
Body of 1 . . . 2
Neck of 2 . . . 20
Hollowed out part . . . 200
Outer thread . . . 201
Skirt—sidewall . . . 21
Bottom . . . 22
Applicator . . . 3
Head of 3 . . . 30
Outer shell of 30 . . . 31
Upper part . . . 310
Side part . . . 311
Threaded inner insert of 30 . . . 32
Inner thread . . . 320
Axial rod . . . 33
Upper end . . . 330
Lower end . . . 331
Application means . . . 34
Brush . . . 34'
Single piece parts 32+33 . . . 35
Wiper . . . 4
Single piece moulded part . . . 4-40
Upper part of 4 . . . 40
Shoulder . . . 400
Lower narrowed part of 4 . . . 41
Lower end . . . 410
Intermediate part between 40 and 41 . . . 42
Click fit means to the neck . . . 43
Assembly 3+4 . . . 5

The invention claimed is:

1. An applicator dispenser (1) of a typically paste cosmetic product, for example a mascara, with an axial direction (i0) and including:

a) a body (2) forming a longitudinal reservoir for said cosmetic product, typically provided with a neck (20) threaded on the outside, a sidewall (21) and a bottom (22), b) an applicator (3) of said cosmetic product comprising a head (30) forming a means of gripping said applicator (3), said head (30) typically being threaded on the inside so as to cooperate with said neck (20) by screwing to seal said body (2) in a leak tight manner, an axial rod (33) fixed at its upper end (330) to said head (30) and at its lower end (331) to an application means (34, 34'), said application means (34, 34') typically dipping into said product when said head is screwed to said neck so that a fraction of said product can be drawn off later, c) and a wiper (4) comprising an upper part (40) fixing said wiper (4) to said neck (20), and a lower narrowed part (41) designed to wipe said application means (34, 34') each time that said applicator (3) is lifted or taken out, characterized in that:

1) said wiper (4) comprises an intermediate axial connecting part (42) between said upper part (40) and said lower part (41),

2) said upper part (40), intermediate part (42) and lower narrowed part (41) of said wiper form a single piece part (4'),

3) said wiper (4, 4') and said body (2) have a ratio $H_E/H_R$ equal to at least 0.3, where $H_E$ and $H_R$ are the axial length or height of said wiper (4, 4') and the depth of said body (2),

4) said lower narrowed part (41) of said wiper (4, 4') has a lower end (410) at a distance d from the bottom (22) of said body (2), said distance d being between $H_A$ and $1.3\times H_A$, where $H_A$ is the axial length or height of said application means (34, 34'), so as to increase the restoration ratio of said product and the usage time of said dispenser.

2. The applicator dispenser according to claim 1 in which said intermediate part (42) of said wiper (4, 4') has a typically circular section with an inside diameter $D_I$, equal to at least the circular section of said application means (34, 34'), such that said intermediate part (42) does not apply any significant wiping action on said application means (34, 34') when said applicator (3) is separated from said body (2), typically in order to use said product to makeup the eyelashes.

3. The applicator dispenser according to claim 2 in which the height $H_{ER}$ of said lower narrowed part (41) of said wiper (4, 4') is such that $H_{ER}/H_E$ is less than 0.5 and typically less than 0.2.

4. The applicator dispenser according to claim 2 in which said distance d is equal to at least $H_A+H_D$, where $H_D$ is the unscrewing height of said head (30) of the applicator (3) with respect to said neck (20), said distance d typically being equal to $H_A+H_D$30 1 mm.

5. The applicator dispenser according to claim 2 in which the axial height $H_{ES}$ of said upper part (40) of said wiper (4, 4') is substantially equal to the height $H_G$ of said neck (20) and typically less than 15 mm.

6. The applicator dispenser according to claim 1 in which the height $H_{ER}$ of said lower narrowed part (41) of said wiper (4, 4') is such that $H_{ER}/H_E$ is less than 0.5 and typically less than 0.2.

7. The applicator dispenser according to claim 6 in which said distance d is equal to at least $H_A+H_D$, where $H_D$ is the unscrewing height of said head (30) of the applicator (3) with respect to said neck (20), said distance d typically being equal to $H_A+H_D$30 1 mm.

8. The applicator dispenser according to claim 6 in which the axial height $H_{ES}$ of said upper part (40) of said wiper (4, 4') is substantially equal to the height $H_G$ of said neck (20) and typically less than 15 mm.

9. The applicator dispenser according to claim 1 in which said distance d is equal to at least $H_A+H_D$, where $H_D$ is the unscrewing height of said head (30) of the applicator (3) with respect to said neck (20), said distance d typically being equal to $H_A+H_{D+}1$ mm.

10. The applicator dispenser according to claim 9 in which the axial height $H_{ES}$ of said upper part (40) of said wiper (4, 4') is substantially equal to the height $H_G$ of said neck (20) and typically less than 15 mm.

11. The applicator dispenser according to claim 1 in which the axial height $H_{ES}$ of said upper part (40) of said wiper (4, 4') is substantially equal to the height $H_G$ of said neck (20) and typically less than 15 mm.

12. The applicator dispenser according to claim 1 in which said wiper (4, 4') is fixed to said neck (20), typically irreversibly by a click fitting means (43) or by gluing or by welding.

13. The applicator dispenser according to claim 1 in which said intermediate part (42) of said wiper (4, 4') has a circular section with an inside diameter $D_I$, varying from 3 mm to 5 mm, and in which said lower narrowed part (41) of said wiper (4, 4') has an orifice diameter $D_R$ varying from 2 mm to 7 mm, such that $D_I/D_R$ is equal to at least 1.5.

14. The applicator dispenser according to claim 1 in which said wiper (4) forms a single piece molded part (4').

15. The applicator dispenser according to claim 1 in which said wiper (4, 4') is formed from a plastic material, typically a thermoplastic material, Chosen from among PP, PE, PU, SEBS and TPE.

16. A method for filling an applicator dispenser (1) with a cosmetic product according to claim 1 in which:

a) said body (2) is procured, b) an assembly (5) is procured or formed containing said applicator (3) and said wiper (4, 4'), said wiper (4, 4') being fixed to said applicator (3) after having been slid onto said axial rod (33) and thus placed between said head (30) and said application means (34), so that it can be manipulated like a single part, c) said cosmetic product is procured, d) said body (2) forming a longitudinal reservoir is filled through its neck (20) with a predetermined quantity of said cosmetic product, and e) said neck (20) of said body (2) is closed by screwing said assembly (5) to said body (2) so as to irreversibly fix said wiper (4, 4') to said neck (20).

* * * * *